US006739907B2

(12) United States Patent
Kuroda et al.

(10) Patent No.: US 6,739,907 B2
(45) Date of Patent: May 25, 2004

(54) COAXIAL CONNECTOR CONTACT AND COAXIAL CONNECTOR HAVING IT

(75) Inventors: Keiji Kuroda, Osaka (JP); Kiyoshi Aramoto, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/394,127

(22) Filed: Mar. 21, 2003

(65) Prior Publication Data

US 2003/0181100 A1 Sep. 25, 2003

(30) Foreign Application Priority Data

Mar. 22, 2002 (JP) ..... 2002-081759

(51) Int. Cl.[7] ..... H01R 9/05

(52) U.S. Cl. ..... 439/582; 439/63

(58) Field of Search ..... 439/63, 582, 578, 439/581

(56) References Cited

U.S. PATENT DOCUMENTS 5,879,190 A * 3/1999 Maruyama et al. ..... 439/582
6,508,668 B1 * 1/2003 Yamane ..... 439/582

* cited by examiner

*Primary Examiner*—Tho D. Ta
(74) *Attorney, Agent, or Firm*—Osha Novak & May L.L.P.

(57) ABSTRACT

A coaxial connector contact has a bonding portion to which the exposed portion of a center conductor of a coaxial cable is to be bonded with solder while being in contact with the bonding portion at a prescribed position, a first positioning portion that is provided at a position to be located on the front side of the exposed portion of the center conductor and is formed so as to be able to support the side faces of the exposed portion of the center conductor from both sides, and a second positioning portion that is provided at a position to be located on the rear side of the exposed portion of the center conductor and is formed so as to be able to support the side faces of the exposed portion of the center conductor from both sides and to be in contact with the end face of an insulator that covers the center conductor.

11 Claims, 12 Drawing Sheets

COAXIAL CONNECTOR CONTACT AND COAXIAL CONNECTOR HAVING IT

FIELD OF THE INVENTION

The present invention relates to a coaxial connector contact that is used in electronic devices such as information terminal devices and computer-related devices as well as to a coaxial connector having such a contact.

BACKGROUND OF THE INVENTION

A coaxial cable used in electronic devices such as information terminal devices and computer-related devices has a sheath, a shield conductor, an insulator, and a center conductor that are arranged in this order from outside. The shield conductor that is given a ground potential is provided around the center conductor for transmission of a data signal. Therefore, usually, a coaxial cable is provided, at one end, with a connector so that the center conductor and the shield conductor can easily be connected to the signal side and the ground side, respectively, of an electronic circuit board.

To attach a connector to one end of a coaxial cable, the coaxial cable is cut in such a manner that the center conductor, the insulator, and the shield conductor are exposed. Then, the center conductor of the coaxial cable is soldered to a flat bonding portion of a coaxial connector contact while being kept in contact with the latter. At this time, if the exposed portion of the center conductor is deviated from a prescribed position relative to the bonding portion, solder flows out of the bonding portion to lower the quality. In view of this, conventionally, various measures are taken in coaxial cable contacts to make it possible to keep the exposed portion of the center conductor in contact with the bonding portion in such a manner that the exposed portion of the center conductor is correctly located at the prescribed position relative to the bonding portion.

For example, JP-A-2001-43939 discloses a coaxial connector contact in which walls are formed adjacent to the front end and the rear end, respectively, of a bonding portion in the axial direction of the center conductor and the rear-end wall is formed with an insertion hole into which to insert the exposed portion of the center conductor. With this structure, the exposed portion of the center conductor of a coaxial cable can be positioned by inserting the exposed portion into the insertion hole of the wall and then bringing the end face of the insulator into contact with the wall. Further, since the two walls serve to prevent a solder outflow during soldering, the solder outflow can be prevented more reliably.

However, in the above conventional structure in which the exposed portion of the center conductor is supported by the rear-end wall in both of the front-rear direction and the right-left direction, the exposed portion of the center conductor is supported at one point on the proximal side. This results in a problem that the front end portion of the center conductor tends to deviate to a large extent from the prescribed position. To position the whole exposed portion of the center conductor at the prescribed position, it is necessary to carefully perform the work of bringing the exposed portion of the center conductor in contact with the bonding portion. This leads to problems of low productivity and increase in production cost, the latter being due to the necessity of a dedicated device for highly accurate positioning. These problems are particularly serious in miniaturizing a coaxial connector to decrease the size and thickness of an electronic device.

An object of the present invention is therefore to provide a coaxial connector contact that makes it possible to correctly bring the exposed portion of the center conductor into contact with the bonding portion at a prescribed position relative to the bonding portion and to easily perform the work of positioning the exposed portion of the center conductor at the prescribed position relative to the bonding portion without the need for using a special external device, as well as a coaxial connector having such a contact.

SUMMARY OF THE INVENTION

A coaxial connector contact according to a first aspect of the invention comprises a bonding portion to which an exposed portion of a center conductor of a coaxial cable is to be soldered while being in contact with the bonding portion; and positioning portions provided so as to be able to support the exposed portion of the center conductor at a plurality of positions in an axial direction of the center conductor so as to position the exposed portion of the center conductor at a prescribed position relative to the bonding portion.

In the above-configured coaxial connector contact, when the exposed portion of the center conductor of a coaxial cable touches the bonding portion, the positioning portions can support the exposed portion of the center conductor at a plurality of locations along the exposed portion and hence can position the exposed portion of the center conductor at the prescribed position. As a result, the degree of uniformity of positions of the exposed portions of center conductors of products can be increased and hence the variation in product quality can also be reduced. Quality deterioration due to a solder outflow from the bonding portion during soldering of the center conductor can be prevented. Further, since the exposed portion of the center conductor can be positioned at the prescribed position by the positioning portion when it touches the bonding portion, the work of positioning the exposed portion of the center conductor at the prescribed position can be performed easily without the need for using a special external device.

At least the positioning portion closest to the front end of the center conductor may have two support pieces that are formed so as to be able to support the side faces of the exposed portion of the center conductor from both sides.

With this structure, the position of the front end portion of the center conductor which is most prone to deviate from the prescribed position relative to the bonding portion can be restricted in the right-left direction between the support pieces. Therefore, the positioning in the right-left direction by the positioning portions can be performed with higher accuracy.

The two support pieces may be formed by cutting and erecting portions of the positioning portion so that they are located on both sides of the exposed portion of the center conductor and opposed to each other.

With this structure, since the support pieces extend over a long distance in the axial direction of the center conductor, the exposed portion of the center conductor can be positioned reliably between the support pieces even if the length of the exposed portion has some error.

The two support pieces may be formed by cutting and erecting, perpendicularly to the axial direction of the center conductor, portions of the positioning portion.

With this structure, since the support pieces extend over a long distance beside a mounting portion of the positioning portion, solder is not prone to leak from the positioning portion during soldering of the center conductor.

The interval between the two support pieces may decrease as the position goes upward.

With this structure, the positioning portion can position, with high accuracy, the exposed portion of the center conductor in both of the right-left direction and the top-bottom direction.

The interval between the two support pieces may increase as the position goes upward.

With this structure, even if the front end portion of the center conductor deviates from the prescribed position relative to the bonding portion when the exposed portion of the center conductor is set from above, the two support pieces guide the front end portion of the center conductor to the prescribed position. Therefore, the work of setting the exposed portion of the center conductor on the bonding portion can further be facilitated.

At least the positioning portion closest to the front end of the center conductor may have a support piece that is formed by cutting and erecting, perpendicularly to the axial direction of the center conductor, a portion of the positioning portion and that is formed with an insertion hole into which to insert the exposed portion of the center conductor.

With this structure, since the support piece extends over a long distance beside a mounting portion of the positioning portion, solder is not prone to leak from the positioning portion during soldering of the center conductor. Further, the positioning portion can position, with high accuracy, the exposed portion of the center conductor in both of the right-left direction and the top-bottom direction.

At least the positioning portion closest to the front end of the center conductor may have a support piece that is formed by cutting and erecting, perpendicularly to an axial direction of the center conductor, a portion of the positioning portion and that is formed with a recess in which to place the exposed portion of the center conductor.

With this structure, since the support piece extends over a long distance beside a mounting portion of the positioning portion, solder is not prone to leak from the positioning portion during soldering of the center conductor. Further, the work of setting the exposed portion of the center conductor on the bonding portion can be facilitated because the exposed portion of the center conductor can be set in the recess from over the positioning portion.

A coaxial connector contact according to a second aspect of the invention comprises a bonding portion to which an exposed portion of a center conductor of a coaxial cable is to be bonded with solder while being in contact with the bonding portion at a prescribed position; a first positioning portion that is provided at a position to be located on a front side of the exposed portion of the center conductor and is formed so as to be able to support side faces of the exposed portion of the center conductor from both sides; and a second positioning portion that is provided at a position to be located on a proximal side of the exposed portion of the center conductor and is formed so as to be able to support side faces of the exposed portion of the center conductor from both sides and to be in contact with an end face of an insulator that covers the center conductor.

In the above-configured coaxial connector contact, when the exposed portion of the center conductor of a coaxial cable touches the bonding portion, the positions, in the right-left direction, of the front end portion and the proximal portion of the exposed portion of the center conductor are restricted by the first positioning portion and the second positioning portion, respectively, whereby the whole exposed portion of the center conductor can be positioned with high accuracy at the prescribed position relative to the bonding portion. Since the second positioning portion is in contact with the end face of the insulator, the exposed portion of the center conductor can be positioned correctly in the front-rear direction, that is, in its axial direction. As a result, the variation of the position of the exposed portion of the center conductor among products can be reduced. And quality deterioration due to a solder outflow from the bonding portion during soldering of the center conductor can also be reduced. Further, the work of positioning the exposed portion of the center conductor at the prescribed position can be performed easily without the need for using a special external device.

The second positioning portion may have a guide groove whose width increases as the position goes upward and that guides the exposed portion of the center conductor to the prescribed position.

With this structure, even if the proximal portion of the exposed portion of the center conductor deviates from the prescribed position relative to the bonding portion when the exposed portion of the center conductor is set from above, the guide groove guides the proximal portion of the exposed portion of the center conductor to the prescribed position. Therefore, the work of setting the exposed portion of the center conductor on the bonding portion can further be facilitated.

A coaxial connector according to the invention comprises a coaxial connector contact having at least one of the above-described features.

The coaxial connector having such a structure can be produced at a high yield.

DESCRIPTION OF THE PREFERRED EMBODIMENTS

A coaxial connector contact and a coaxial connector having it according to an embodiment of the present invention will be hereinafter described with reference to FIGS. 1–5.

Figure 1:
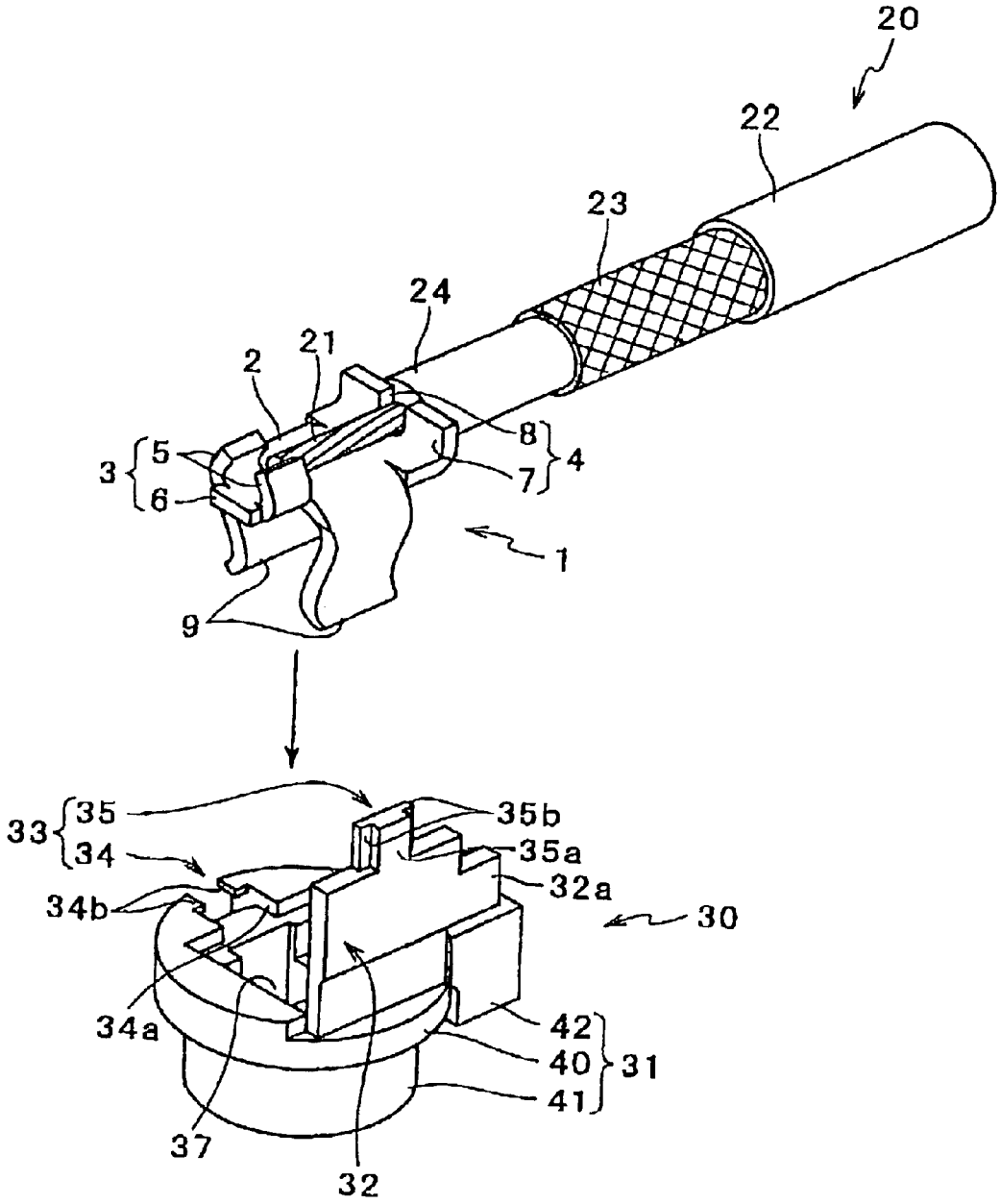
FIG. 1 illustrates how a coaxial connector contact is housed in a housing.

As shown in FIG. 1, a coaxial connector contact 1 according to the embodiment is formed by working on a metal plate. The metal plate may be made of a metal such as iron, aluminum, or copper or an alloy having one of these metals as a main component. The coaxial connector contact 1 has a bonding portion 2 to which the exposed portion of a center conductor 21 of a coaxial cable 20 is to be soldered while being kept in contact with it. The coaxial cable 20 has a sheath 22, a shield conductor 23, an insulator 24, and the center conductor 21 that are arranged in this order from outside to the center. The shield conductor 23 that is given a ground potential is provided around the center conductor 21 for transmission of a data signal.

The bonding portion 2 assumes a flat shape to make solder less flowable. A pair of elastic contact portions 9 are provided symmetrically on both sides (in the right-left direction) of the bonding portion 2. The two contact portions 9, which extend downward from the bonding portion 2, are to be fitted with the other connector (not shown). On the other hand, a first positioning portion 3 and a second positioning portion 4 are provided adjacent to the front end and the rear end of the bonding portion 2, respectively. The first positioning portion 3 and the second positioning portion 4 are configured so as to be able to support the exposed portion of the center conductor 21 at a plurality of locations in the axial direction of the center conductor 21 so that the exposed portion of the center conductor 21 is positioned at a prescribed position of the bonding portion 2.

The term "front end" of the bonding portion 2 means its end that is located on the front side of the center conductor 21 in the case where the axial direction of the center conductor 21 being in contact with the bonding portion 2 is defined as a front-rear direction. On the other hand, the term "rear end" of the bonding portion 2 means its end that is located on the rear (proximal) side of the exposed portion of the center conductor 21. The term "right-left direction" means a direction that is perpendicular to the axial direction of the center conductor 21 and parallel with the top surface of the bonding portion 2. The term "top-bottom direction" means a direction that is perpendicular to both of the axial direction of the center conductor 21 and the top surface of the bonding portion 2.

Figure 2A:
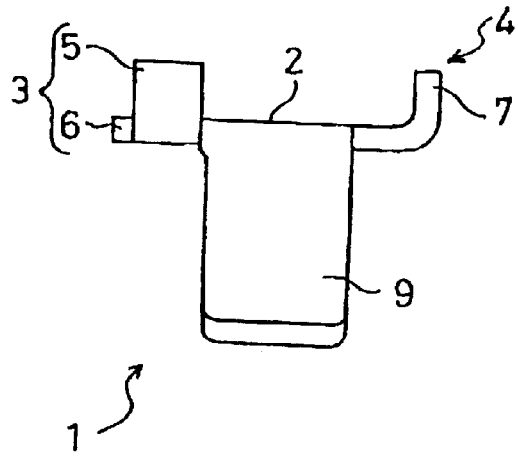
FIGS. 2A–2C are a front view, a side view, and a plan view, respectively, showing the structure of the coaxial connector contact.
Figure 2B:
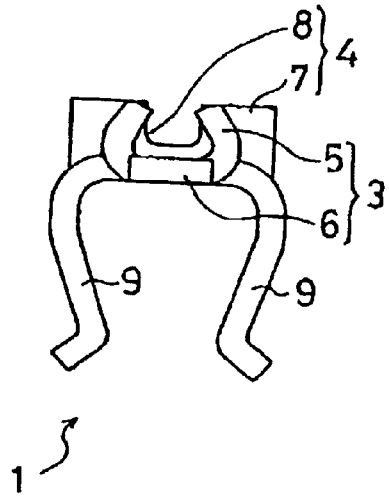
Figure 2C:
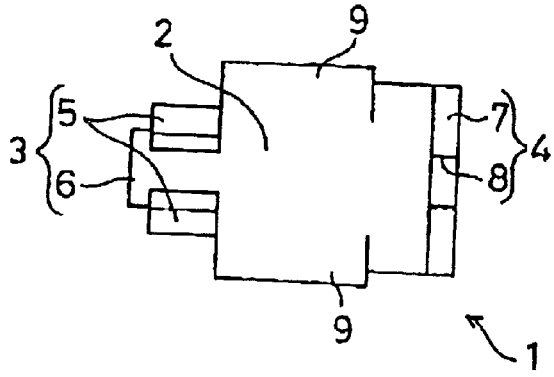

As shown in FIGS. 2A–2C, the first positioning portion 3 which is provided adjacent to the front end of the bonding portion 2 has a mounting portion 6 on which the front end portion of the center conductor 21 is mounted and a pair of support pieces 5 that are located on-both sides (in the right-left direction) of the mounting portion 6 as a center. The mounting portion 6 projects forward from the center of the bonding portion 2. The support pieces 5 are formed by cutting and erecting side portions of the first positioning portion 3 and are located on both sides of the front end portion of the center conductor 21 so as to be opposed to each other.

The interval between the two support pieces 5 is set the same as or slightly longer than the diameter of the center conductor 21 so as to be able to support the side surfaces of the front end portion of the center conductor 21 from both sides. If the middle point of the two support pieces 5 is defined as a prescribed position, it is preferable that the interval be set to such a value that no problems will occur during soldering even if the front end portion of the center conductor 21 deviates from the prescribed position. This allows the first positioning portion 3 to restrict, in the right-left direction, by means of the support pieces 5, the position of the front end portion of the center conductor 21 which is most prone to deviate from the prescribed position relative to the bonding portion 2. Further, since the support pieces 5 of the first positioning portion 3 extend over a long distance in the front-rear direction, the front end portion of the center conductor 21 can reliably be placed between the support pieces 5 even if the length of the exposed portion of the center conductor 21 has some error.

The two support pieces 5 are curved inward over their whole length in the top-bottom direction. As a result, the interval between the two support pieces 5 of the first positioning portion 3 decreases as the position goes upward, which makes it possible for the first positioning portion 3 to position the front end portion of the center conductor 21 with high accuracy in the right-left direction and the top-bottom direction. The two support pieces 5 may be curved inward over their whole length in the top-bottom direction, or they may extend straightly in the top-bottom direction except for their top portions that are curved or bent inward.

On the other hand, a second positioning portion 4 is provided adjacent to the rear end of the bonding portion 2. The second positioning portion 4 has a positioning piece 7 formed by cutting and erecting a portion of the second positioning portion 4 perpendicularly to the axial direction of the center conductor 21 and a guide groove 8 that is formed at the center of the positioning piece 7. The width of the guide groove 8 is set the same as or slightly greater than the diameter of the center conductor 21. If the center of the guide groove 8 is defined as a prescribed position, it is preferable that the width of the guide groove 8 be set to such a value that no problems will occur during soldering even if the rear end portion of the exposed portion of the center conductor 21 deviates from the prescribed position. This allows the second positioning portion 4 to hold the proximal portion of the exposed portion of the center conductor 21 in the right-left direction and to correctly position the exposed portion of the center conductor 21 also in the front-rear direction by bringing the positioning piece 7 in contact with the end face of the insulator 24.

The coaxial connector contact 1 having the above structure is housed in a housing 30 as shown in FIG. 1. The housing 30 is formed by molding an insulative material. The insulative material may be any of all insulative synthetic resin materials of a PBT type, a nylon type, a PPS type, an LCP type, and the like. The housing 30 has a generally cylindrical housing main body 31, a housing lid 32 for covering the contact 1 from above, and a first latching mechanism 33 for maintaining a latched state of the housing lid 32 and the housing main body 31. The housing lid 32 is formed in such a manner that a first side portion of a top peripheral portion of the housing main body 31 serves as its fixed end. When bent at the fixed end, the free end of the housing lid 32 can touch a second side portion, opposite to the first side portion, of the top peripheral portion of the housing main body 31 and cover the contact 1 from above.

The housing main body 31 has a top housing portion 40 and a bottom housing portion 41. The housing main body 31 also has a contact accommodation hole 37 for accommodating the coaxial connector contact 1. The contact accommodation hole 37 occupies a central space of the housing main body 31. The contact accommodation hole 37 communicates with a top surface opening and a bottom surface opening of the housing main body 31. The contact accommodation hole 37 is formed in such a manner that the bonding portion 2, the first positioning portion 3, and the second positioning portion 4 are accommodated in the top housing portion 40, and that the contact portions 9 are accommodated in contact accommodation hole 37 the bottom housing portion 41.

The top housing portion 40 is provided with a main-body-side latching portion 34, which is located in the second side portion of the top peripheral portion of the housing main body 31. The main-body-side latching portion 34 has a fitting groove 34*a* having a prescribed width and projections 34*b* that project inward from top portions of the side faces of the fitting groove 34*a*. The fitting groove 34*a* extends in the radial direction from the contact accommodation hole 37 to the outer circumferential surface.

The main-body-side latching portion 34 is one component of the first latching mechanism 33. The first latching mechanism 33 has a lid-side latching portion 35 in addition to the main-body-side latching portion 34. The lid-side latching portion 35 is a free-end-side portion of the housing lid 32, and has a projection piece 35*a* that projects approximately from the center of the free end of the housing lid 32. The width of the projection piece 35*a* is set equal to the interval between the projections 34*b*. Step portions 35*b* project from both side faces of the projection piece 35*a*. The width of the projection piece 35*a* plus the step portions 35*b* is set slightly smaller than the width of the fitting groove 34*a*. When the projection piece 35*a* is fitted into the fitting groove 34*a*, the top surfaces of the step portions 35*b* touch the respective projections 34*b*. The step portions 35*b*'s being in contact with the projections 34*b* generates a force of maintaining the state that the housing lid 32 is in contact with the housing main body 31.

Figure 4:
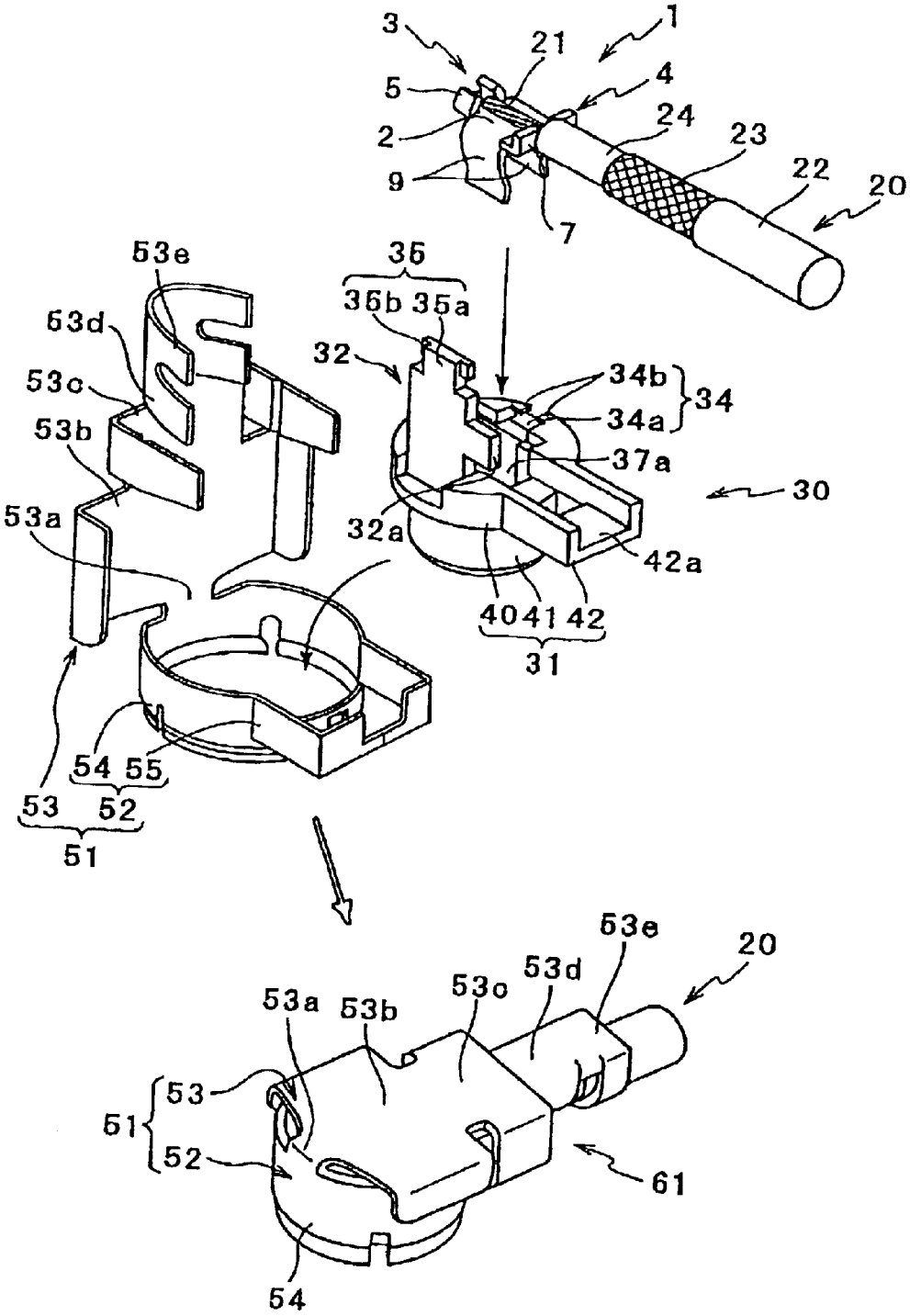
FIG. 4 illustrates how a coaxial connector is assembled.

As shown in FIG. 4, the top housing portion 40 of the housing main body 31 is formed with a cable accommodation portion 42 for accommodating the shield conductor 23 of the coaxial cable 20. The cable accommodation portion 42 is formed so as to extend perpendicularly to the longitudinal direction of the housing lid 32 being in contact with the housing main body 31 and to be directed to the center of the housing main body 31. The housing lid 32 is also formed with a cover portion 32*a* for covering, from above, the shield conductor 23 of the coaxial cable 20 being accommodated in the cable accommodation portion 42. The cover portion 32*a* can prevent a lift of the shield conductor 23 when a lifting force acts on the coaxial cable 20.

The above-configured housing 30 is accommodated in a shell 51, which is formed by working on a metal plate. The metal plate may be made of a metal such as iron, aluminum, or copper or an alloy having one of these metals as a main component. The shell 51 has a shell main body 52 for accommodating the housing 30 and a shell lid member 53 that is integral with the shell main body 52. The shell main body 52 has a main housing accommodation portion 54 and an auxiliary housing accommodation portion 55. The main housing accommodation portion 54 has a cylindrical shape having top and bottom openings so as to be able to accommodate the top housing portion 40 and the bottom housing portion 41 of the housing main body 31. The auxiliary housing accommodation portion 55 has a box shape having a top opening so as to be able to accommodate the cable accommodation portion 42 of the housing main body 31.

On the other hand, the shell lid member 53 extends from the top peripheral portion of the main housing accommodation portion 54. The shell lid member 53 can be bent at a connecting portion 53*a*, and is opposed to the auxiliary housing accommodation portion 55 when bent there. The shell lid member 53 has a first lid portion 53*b* for covering the main housing accommodation portion 54 from above, a second lid portion 53*c* for covering the auxiliary housing accommodation portion 55 from above, a conductor press attach portion 53*b* to be crimp-connected to the shield conductor 23 of the coaxial cable 20, and a sheath press attach portion 53*e* to be crimp-connected to the sheath 22 of the coaxial cable 20. Before being bent, the shell lid member 53 erects from the main housing accommodation portion 54. In this state, the housing 30 can be accommodated in the main housing accommodation portion 54 through its top opening. When the shell lid member 53 is bent at the connecting portion 53*a* to touch the shell main body 52, the first lid portion 53*b* and the second lid portion 53*c* cover, from above, the top housing portion 40 and the cable accommodation portion 42, respectively, of the housing main body 31 being accommodated in the shell main body 52 and the conductor press attach portion 53*d* is in a state that it can be crimp-connected to the shield conductor 23 of the coaxial cable 20.

The shell lid member 53 is provided in such a manner that its longitudinal direction is perpendicular to the longitudinal direction of the housing lid 32 when the shell lid member 53 is bent to touch the shell main body 52. The shell lid member 53 may be provided at an arbitrary position as long as it does not interfere with the housing lid 32 when they are erected.

A manufacturing method of the above-configured coaxial connector contact 1 and coaxial connector will be described below.

Contact Working Step

First, as shown in FIGS. 1 and 2A–2C, a thin, band-shaped thin metal plate is prepared and transported to a press machine. In the press machine, one side portion (in the width direction) of band-shaped metal plate is cut and deformed while the other side portion is left as a carrier (not shown), whereby coaxial connector contacts 1 that are arranged at regular intervals and connected to the carrier are formed successively. Then, the coaxial connector contacts 1 are wound up on a reel in roll form together with the carrier.

Soldering Step

Figure 3A:
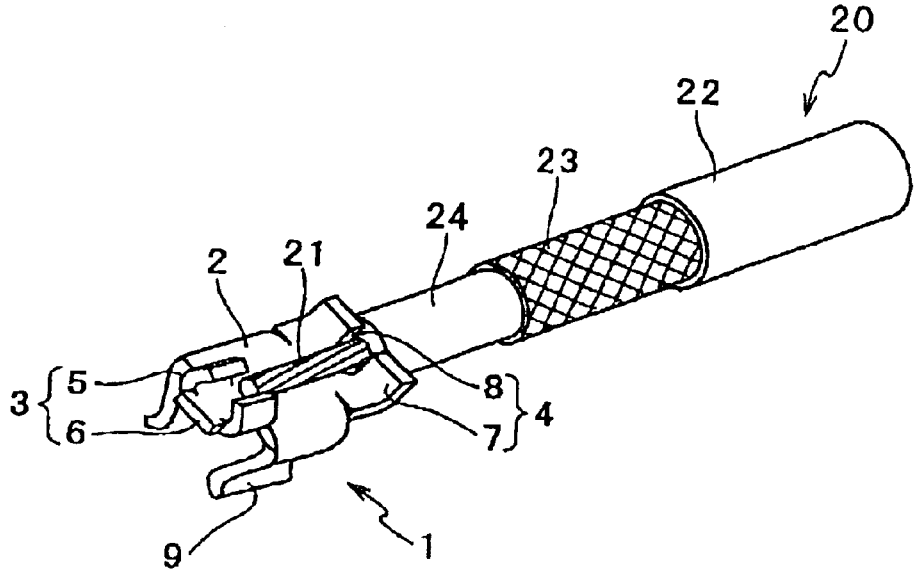
FIGS. 3A and 3B illustrate how a coaxial cable is bonded to the coaxial connector contact, and specifically show states before and after soldering, respectively.

The coaxial connector contacts 1 in roll form are set in a paying-out device and the front coaxial connector contact 1 is mounted on a fixing device for welding. To prevent a solder outflow, the coaxial connector contact 1 is mounted in such a manner that the top surface of the bonding portion 2 is set horizontal. Then, as shown in FIG. 3A, a coaxial cable 20 is prepared that is cut into a prescribed length. The tip portion of the coaxial cable 20 is peeled in two steps with such a jig as a stripper, whereby the center conductor 21, the insulator 24, and the shield conductor 23 are exposed. The exposure length of the center conductor 21 is set approximately equal to the interval between the first positioning portion 3 and the second positioning portion 4 of the coaxial connector contact 1 so that the front and portion of the center conductor 21 is placed inside the first positioning portion 3. Coaxial cables 20 that have been peeled in two steps may be prepared in advance.

Then, the two-step-peeled coaxial cable 20 is moved to above the coaxial connector contact 1 that is mounted on the fixing device. The coaxial cable 20 is set in the coaxial connector contact 1 in such a manner that the center conductor 21 is in contact with the bonding portion 2 of the coaxial connector contact 1. At this time, the end face of the insulator 24 of the coaxial cable 20 is brought into contact with the positioning piece 7 of the second positioning portion 4, whereby the exposed portion of the center conductor 21 is positioned in the front-rear direction of the bonding portion 2. As a result, the rear end portion (proximal portion) of the exposed portion of the center conductor 21 is placed inside the guide groove 8 of the second positioning portion 4 and its front end portion is placed between the support pieces 5 of the first positioning portion 3. The exposed portion of the center conductor 21 can reliably be placed between the support pieces 5 even if the exposure length of the center conductor 21 has some error, because the support pieces 5 were formed by cutting and erecting both side portions of the first positioning portion 3 so that they would be opposed to each other with the center conductor 21 interposed in between.

As a result, the two portions, that is, the front end portion and the rear end portion, of the exposed portion of the center conductor 21 are supported by the respective positioning portions 3 and 4, whereby the exposed portion of the center conductor 21 is positioned so as to be located in an allowable range (in the right-left direction) relative to the prescribed position. In particular, since the position of the front end portion of the center conductor 21 which is most prone to deviate from the prescribed position relative to the bonding portion 2 is restricted in the right-left direction between the support pieces 5, the positioning of the front end portion in the right-left direction can be performed with high accuracy. The support pieces 5 are curved inward and hence the interval between the two support pieces 5 decreases as the position goes upward. Therefore, the front end portion of the center conductor 21 is accommodated inside the support pieces 5. This makes it possible to position the front end portion of the center conductor 21 in both of the right-left direction and the top-bottom direction even if its front end portion is warped upward.

Figure 3B:
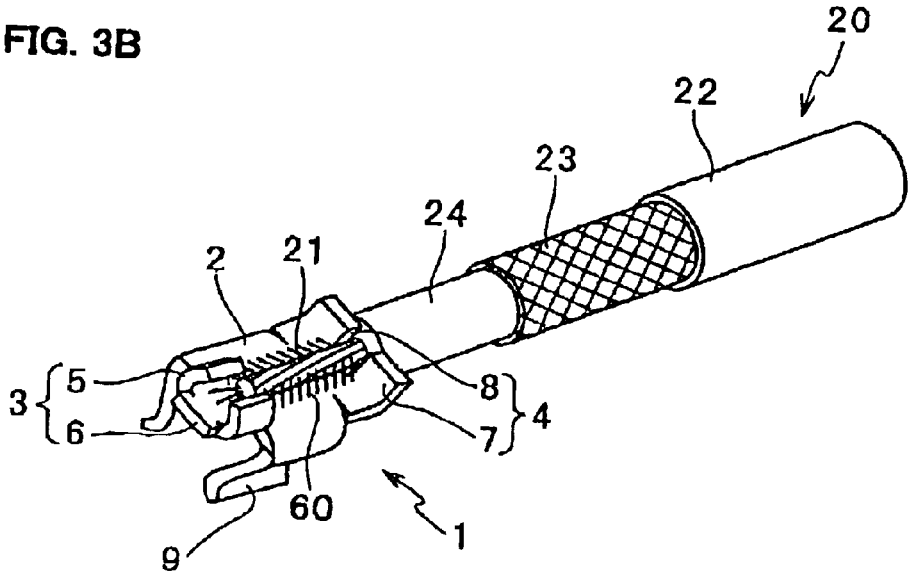

Then, as shown in FIG. 3B, the exposed portion of the center conductor 21 is soldered to the bonding portion 2 while being in contact with the bonding portion 2. During the soldering, solder 60 in liquid form flows outward from the center conductor 21 on the bonding portion 2. During that course, part of the solder 60 flowing on the bonding portion 2 in the right-left direction is well prevented from reaching the contact portions 9 that are located on both sides in the right-left direction, because the center conductor 21 is located on the center line, in the right-left direction, of the bonding portion 2. Part of the solder 60 flowing on the bonding portion 2 in the front-rear direction is well prevented from leaking to the back side of the bonding portion 2 because the support pieces 5 of the first positioning portion 3 and the positioning piece 7 of the second positioning portion 4 serve as walls for stopping a flow of the solder 60. As a result, even if the exposure length of the center conductor 21 has some variation or the front end portion or the whole exposed portion of the center conductor 21 is curved, the center conductor 21 can reliably be soldered to the bonding portion 2 and quality deterioration due to an outflow of the solder 60 from the bonding portion 2 can be avoided.

After completion of the above soldering, the coaxial connector contact 1 is cut off from the carrier (not shown). The coaxial connector contact 1 is detached from the fixing device and transported to the next step, that is, a mounting step.

Mounting Step

In the mounting step, first, a shell 51 (see FIG. 4) is set in a mounting device (not shown). A housing 30 is set in the main housing accommodation portion 54 of the shell 51. At this time, the cable accommodation portion 42 of the housing main body 31 is accommodated in the auxiliary housing accommodation portion 55 of the shell 52, whereby the housing 30 is fixed to the shell main body 52 and oriented horizontally.

Then, the coaxial connector contact 1 having the coaxial cable 20 that was produced in the soldering step is inserted into the contact accommodation hole 37 of the housing main body 31. And the insulator 24 of the coaxial cable 20 is accommodated in the cable accommodation portion 42, whereby the coaxial connector contact 1 is fixed to the housing main body 31 and oriented horizontally. Then, the housing lid 32 is bent at the fixed end and hence is inclined toward the housing main body 31. As a result, the top opening of the coaxial connector contact 1 is closed by the housing lid 32.

When the top opening of the coaxial connector contact 1 is closed by the housing lid 32, the lid-side latching portion 35 is fitted into the main-body-side latching portion 34. As a result, the step portions 35*b* of the lid-side latching portion 35 touch the projections 34*b* of the main-body-side latching portion 34, whereby the lid-side latching portion 35 and the main-body-side latching portion 34 are latched together. The latched state produces a force of maintaining the closed state of the housing lid 32. Therefore, the coaxial connector contact 1 is prevented from lifting by the housing lid 32 and is kept accommodated in the contact accommodation hole 37 in a desired accommodation posture.

Figure 5:
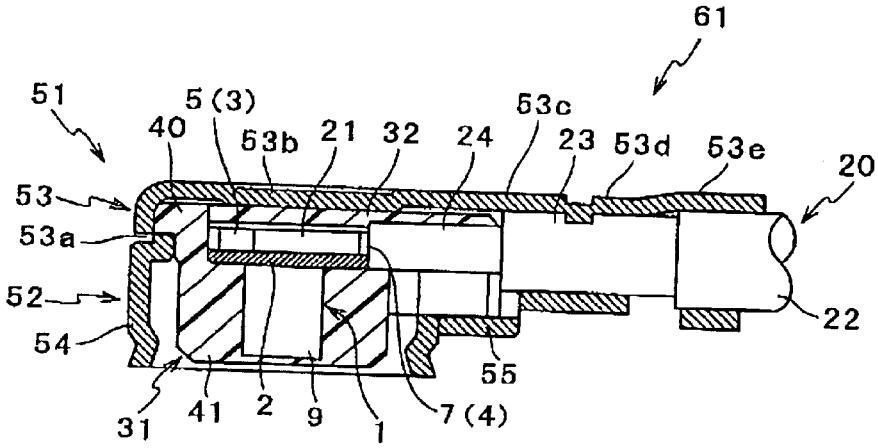
FIG. 5 is a sectional view of the coaxial connector.

Then, the shell lid member 53 is bent at the connecting portion 53*a* and hence is inclined toward the shell main body 52. The housing portions 40 and 41 of the housing main body 31 in which the coaxial connector contact 1 is housed are covered with the first lid portion 53*b*. The exposed portion of the insulator 24 of the coaxial cable 20 that is accommodated in the cable accommodation portion 42 is covered with the second lid portion 53*c*. Further, the conductor press attach portion 53*d* and the sheath press attach portion 53*e* touch and are press-attached to the exposed portion of the shield conductor 23 and the sheath 22, respectively. As a result, as shown in FIG. 5, a coaxial connector 61 is produced in which the coaxial connector contact 1 to which the center conductor 21 of the coaxial cable 20 is soldered and the shell 51 to which the shield conductor 23 is connected are electrically insulated from each other in the housing main body 31.

As described above and shown in FIGS. 1 and 2A–2C, the coaxial connector contact 1 according to this embodiment has the bonding portion 2 to which the exposed portion of the center conductor 21 of the coaxial cable 20 is to be bonded with solder 60 while being in contact with the bonding portion 2 at a prescribed position, the first positioning portion 3 that is provided at a position to be located on the front side of the exposed portion of the center conductor 21 and is formed so as to be able to support the side faces of the exposed portion of the center conductor 21 from both sides, and the second positioning portion 4 that is provided at a position to be located on the rear (proximal) side of the exposed portion of the center conductor 21 and is formed so as to be able to support the side faces of the exposed portion of the center conductor 21 from both sides and to be in contact with the end face of the insulator (dielectric) 24 that covers the center conductor 21.

In the above-configured coaxial connector contact 1, when the exposed portion of the center conductor 21 of the coaxial cable 20 touches the bonding portion 2, the positions, in the right-left direction, of the front end portion and the rear proximal end portion of the exposed portion of the center conductor 21 are restricted by the first positioning portion 3 and the second positioning portion 4, respectively, whereby the whole exposed portion of the center conductor 21 can be positioned with high accuracy at the prescribed position relative to the bonding portion 2. Since the second positioning portion 4 is in contact with the end face of the insulator 24, the exposed portion of the center conductor 21 can be positioned correctly in the front-rear direction, that is, in its axial direction. As a result, the variation of the position of the exposed portion of the center conductor 21 among products can be reduced and hence the variation in quality can also be reduced. Further, quality deterioration due to an outflow of solder 60 from the bonding portion 2 during soldering of the center conductor 21 can be prevented, and the work of positioning the exposed portion of the center conductor 21 at the prescribed position can be performed easily without the need for using a special external device.

The first positioning portion 3 according to this embodiment is provided with the support pieces 5 that are formed so as to be able to support the side faces of the front end portion of the center conductor 21 from both sides. This makes it possible to restrict the position, in the right-left direction, of the front end portion of the center conductor 21 which is most prone to deviate from the prescribed position (between the support pieces 5) relative to the bonding portion 2, and thereby allows the positioning in the right-left direction by the first positioning portion 3 to be performed with higher accuracy.

The support pieces 5 according to this embodiment are formed by cutting and erecting, perpendicularly to the axial direction of the center conductor 21, portions of the first positioning portion 3. As a result, the support pieces 5 exist over a long distance beside the mounting portion 6 of the first positioning portion 3, whereby solder 60 is not prone to leak from the first positioning portion 3 during soldering of the center conductor 21. Further, since the interval between the two support pieces 5 decreases as the position goes upward, the first positioning portion 3 can position the front end portion of the center conductor 21 with high accuracy in both of the right-left direction and the top-bottom direction.

Figure 6A:
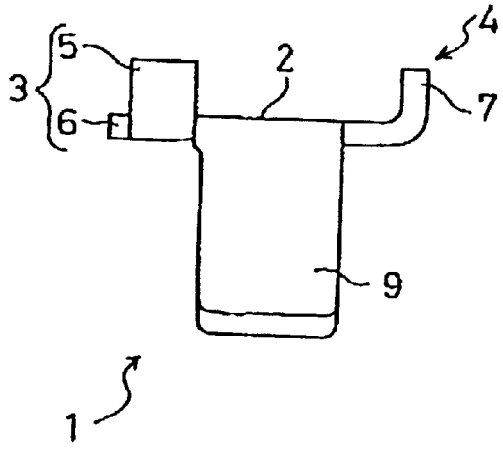
FIGS. 6A–6C are a front view, a side view, and a plan view, respectively, showing the structure of another coaxial connector contact.
Figure 6B:
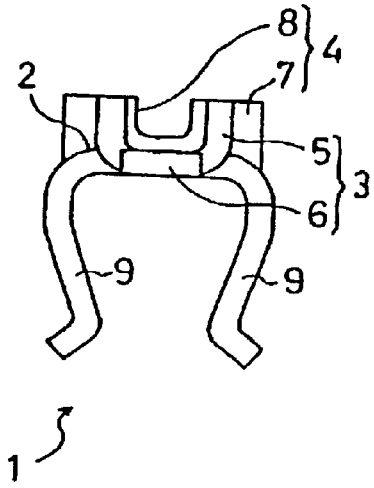
Figure 6C:
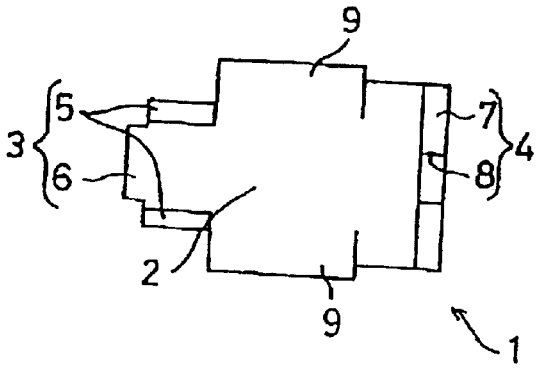
Figure 7A:
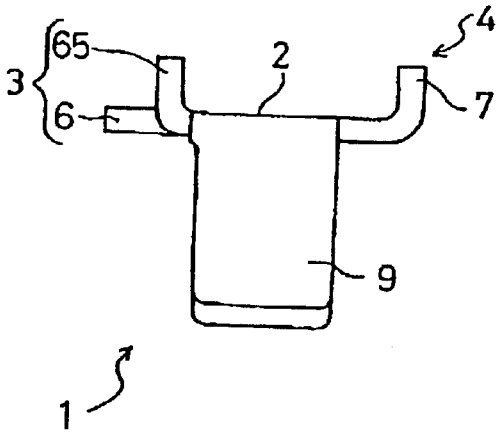
FIGS. 7A–7C are a front view, a side view, and a plan view, respectively, showing the structure of another coaxial connector contact.
Figure 7B:
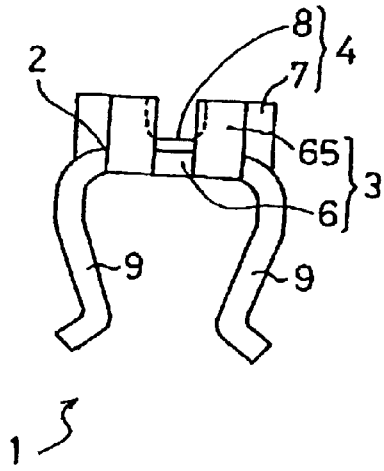
Figure 7C:
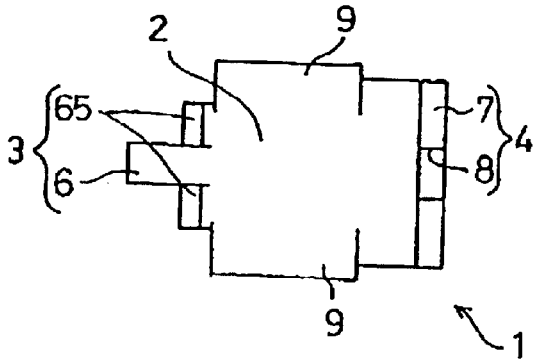

The preferred embodiment of the invention has been described above. However, various modifications are possible without departing from the spirit and scope of the invention. For example, as shown in FIGS. 6A–6C, the coaxial connector contact 1 may have support pieces 5 that extend straightly in the vertical direction. As shown in FIGS. 7A–7C, the coaxial connector contact 1 may have support pieces 65 that are formed by cutting and erecting, perpendicularly to the axial direction of the center conductor 21, portions of the first positioning portion 3. In this structure, the support pieces 65 exist over a long distance beside a mounting portion 6 of the first positioning portion 3, whereby solder 60 is not prone to leak from the first positioning portion 3 during soldering of the center conductor 21.

Figure 8A:
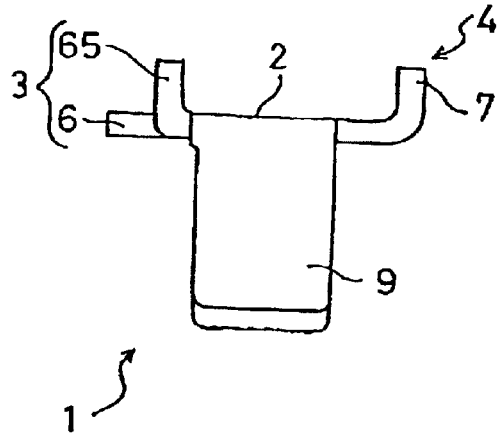
FIGS. 8A–8C are a front view, a side view, and a plan view, respectively, showing the structure of still another coaxial connector contact.
Figure 8B:
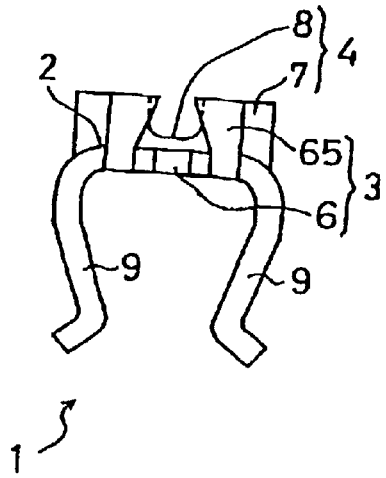
Figure 8C:
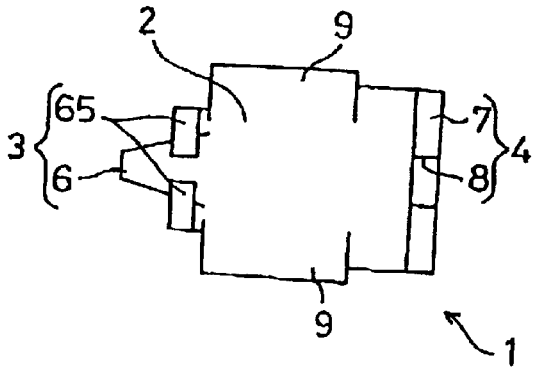
Figure 9A:
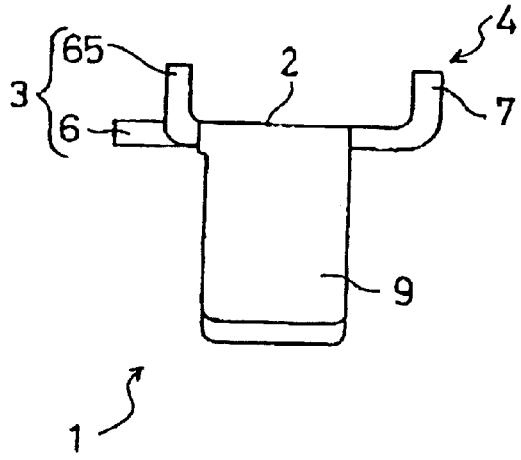
FIGS. 9A–9C are a front view, a side view, and a plan view, respectively, showing the structure of another coaxial connector contact.
Figure 9B:
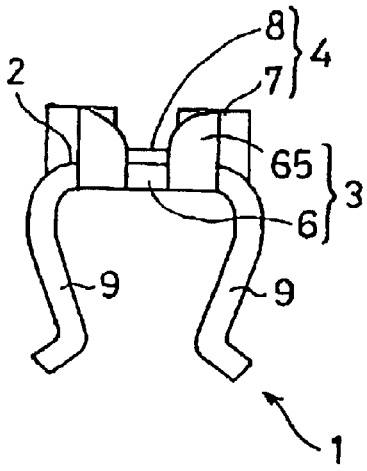
Figure 9C:
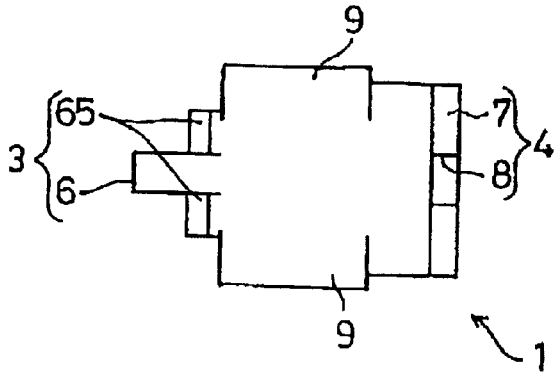

As shown in FIGS. 8A–8C, the interval between the two support pieces 65 may decrease as the position goes upward. In this case, the first positioning portion 3 can position the front end portion of the center conductor 21 with high accuracy in both of the right-left direction and the top-bottom direction. On the contrary, as shown in FIGS. 9A–9C, the interval between the two support pieces 65 may increase as the position goes upward. In this case, even if the front end portion of the center conductor 21 deviates from the prescribed position relative to the bonding portion 2 when the exposed portion of the center conductor 21 (see FIG. 1) is set from above, the two support pieces 65 guide the front end portion of the center conductor 21 to the prescribed position. Therefore, the work of setting the exposed portion of the center conductor 21 on the bonding portion 2 can further be facilitated.

Figure 10A:
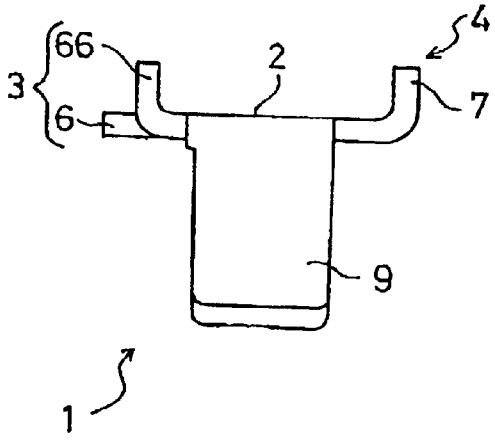
FIGS. 10A–10C are a front view, a side view, and a plan view, respectively, showing the structure of another coaxial connector contact.
Figure 10B:
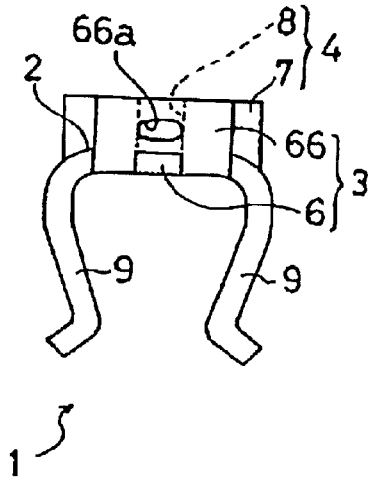
Figure 10C:
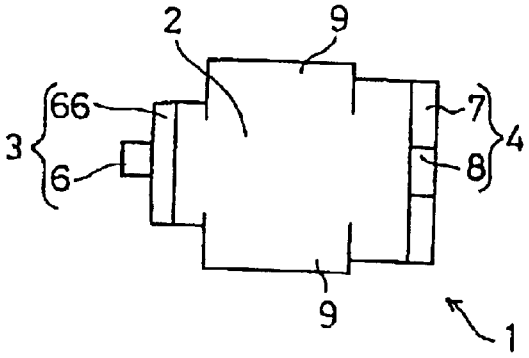

As shown in FIGS. 10A–10C, the coaxial connector contact 1 may have a support piece 66 that is formed by cutting and erecting, perpendicularly to the axial direction of the center conductor 21, a portion of the first positioning portion 3 and that has an insertion hole 66*a* into which to insert the center conductor 21. In this case, the support piece 66 exists over a long distance beside a mounting portion 6 of the first positioning portion 3, whereby solder 60 is not prone to leak from the first positioning portion 3 during soldering of the center conductor 21. Further, the first positioning portion 3 can position the front end portion of the center conductor 21 with high accuracy in both of the right-left direction and the top-bottom direction.

Figure 11A:
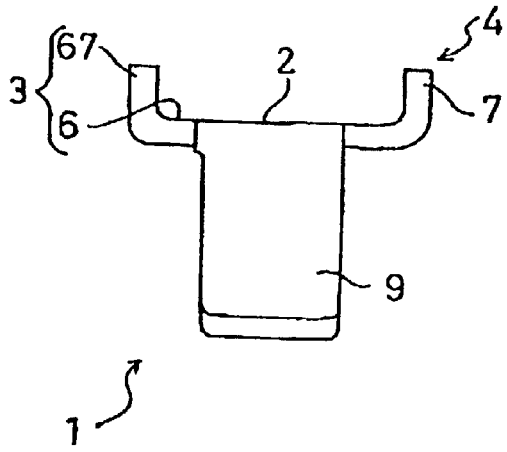
FIGS. 11A–11C are a front view, a side view, and a plan view, respectively, showing the structure of yet another coaxial connector contact.
Figure 11B:
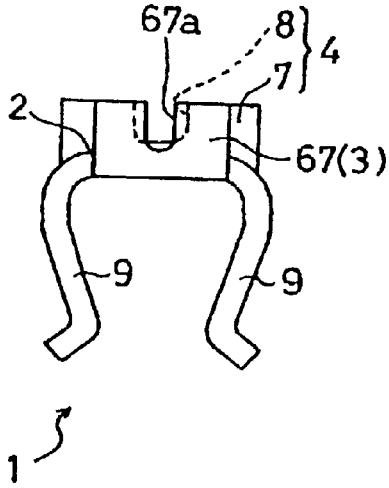
Figure 11C:
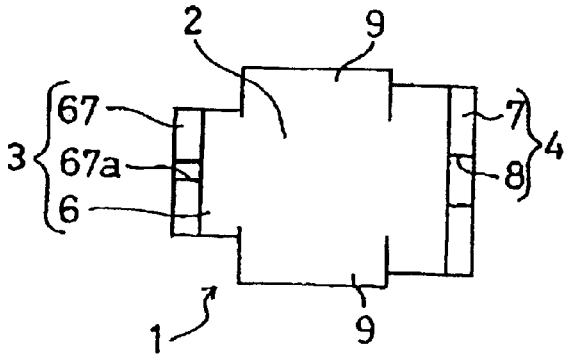

As shown in FIGS. 11A–11C, the coaxial connector contact 1 may have a support piece 67 that is formed by cutting and erecting, perpendicularly to the axial direction of the center conductor 21, a portion of the first positioning portion 3 and that has, in the upper part, a recess 67 in which to place the center conductor 21. In this case, the support piece 67 exists over a long distance beside a mounting portion 6 of the first positioning portion 3, whereby solder 60 is not prone to leak from the first positioning portion 3 during soldering of the center conductor 21. Further, since the front end portion of the center conductor 21 can be set in the recess 67*a* from above, the work of setting the front end portion of the center conductor 21 in the first positioning portion 3 can be facilitated.

Figure 12A:
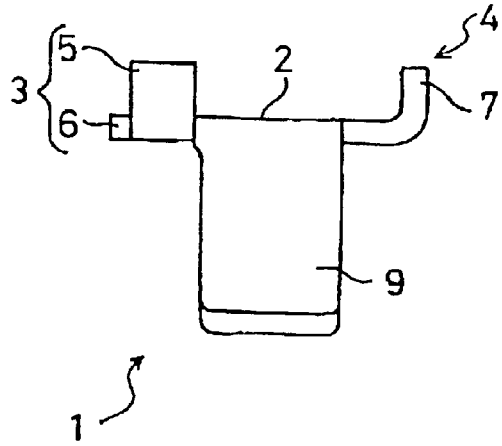
FIGS. 12A–12C are a front view, a side view, and a plan view, respectively, showing the structure of a further coaxial connector contact.
Figure 12B:
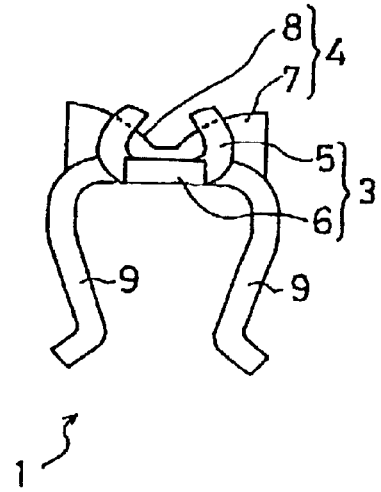
Figure 12C:
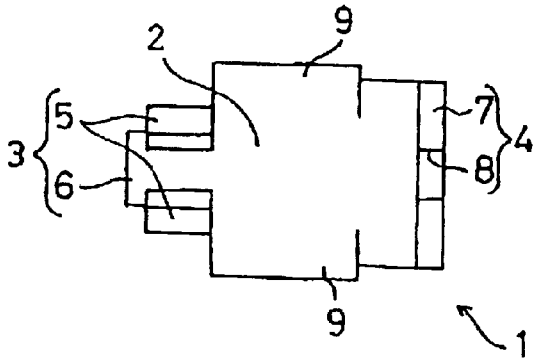

As shown in FIGS. 12A–12C, the positioning piece 7 of the second positioning portion 4 of the coaxial connector contact 1 may have a guide groove 8 whose width increases as the position goes upward and that guides the rear end portion of the exposed portion of the center conductor 21 to the prescribed position. In this case, even if the proximal portion of the exposed portion of the center conductor 21 deviates from the prescribed position relative to the bonding portion 2 when the exposed portion of the center conductor 21 is set from above, the guide groove 8 guides the proximal portion of the exposed portion of the center conductor 21 to the prescribed position. Therefore, the work of setting the exposed portion of the center conductor 21 on the bonding portion 2 can further be facilitated.

In the above-described embodiment, as shown in FIGS. 2A–2C, for example, the first positioning portion 3 and the second positioning portion 4 are formed adjacent to the front end and the rear end, respectively, of the bonding portion 2. However, the invention is not limited to such a case. That is, it is sufficient for the coaxial connector contact 1 to have the bonding portion 2 to which the exposed portion of the center conductor 21 of the coaxial cable 20 is to be soldered by the solder 60 while being in contact with the bonding portion 2, and a plurality of positioning portions provided so as to be able to support the exposed portion of the center conductor 21 at a plurality of positions in the axial direction of the center conductor 21 so as to position the exposed portion of the center conductor 21 at a prescribed position relative to the bonding portion 2. More specifically, the number of positioning portions and their locations are not restricted as long as two or more positioning portions are provided. Even with this structure, when the exposed portion of the center conductor 21 of the coaxial cable 20 touches the bonding portion 2, the positioning portions can support the exposed portion of the center conductor 21 at a plurality of locations along the exposed portion. Therefore, the exposed portion of the center conductor 21 can be positioned at the prescribed position relative to the bonding portion 2.

In the above-described embodiment, as shown in FIGS. 2 and FIGS. 6A–6C to 12A–12C, only the first positioning portion 3 has the support piece(s) 5, 65, 66, 67, or 68. However, the second positioning portion 4 may also have similar support piece(s) 5, 65, 66, 67, or 68. Where the support piece(s) 5, 65, 66, 67, or 68 are provided at two or more locations, it is appropriate that at least the positioning portion closest to the front end of the center conductor 21 has the support piece(s) 5, 65, 66, 67, or 68.

Availability on Industry

The above-described coaxial connector contact and coaxial connector having it can be applied to electronic devices such as information terminal devices and computer-related devices.

What is claimed is:

1. A coaxial connector contact comprising:

a bonding portion to which an exposed portion of a center conductor of a coaxial cable is to be soldered while being in contact with the bonding portion; and positioning portions provided so as to be able to support the exposed portion of the center conductor at a plurality of positions in an axial direction of the center conductor so as to position the exposed portion of the center conductor at a prescribed position relative to the bonding portion, wherein at least a positioning portion closest to a front end of the center conductor has two support pieces that are formed so as to be able to support side faces of the exposed portion of the center conductor from both sides.

2. The coaxial connector contact according to claim 1, wherein the two support pieces are formed by cutting and erecting portions of the positioning portion so that they are located on both sides of the exposed portion of the center conductor and opposed to each other.

3. The coaxial connector contact according to claim 1, wherein the two support pieces are formed by cutting and erecting, perpendicularly to an axial direction of the center conductor, portions of the positioning portion.

4. The coaxial connector contact according to claim 1, wherein the interval between the two support pieces decreases as the position goes upward.

5. The coaxial connector contact according to claim 1, wherein the interval between the two support pieces increases as the position goes upward.

6. A coaxial connector comprising the coaxial connector contact according to claim 1.

7. A coaxial connector contact comprising:

a bonding portion to which an exposed portion of a center conductor of a coaxial cable is to be soldered while being in contact with the bonding portion; and positioning portions provided so as to be able to support the exposed portion of the center conductor at a plurality of positions in an axial direction of the center conductor so as to position the exposed portion of the center conductor at a prescribed position relative to the bonding portion, wherein at least a positioning portion closest to a front end of the center conductor has a support piece that is formed by cutting and erecting, perpendicularly to an axial direction of the center conductor, a portion of the positioning portion and that is formed with an insertion hole into which to insert the exposed portion of the center conductor.

8. A coaxial connector contact comprising:

a bonding portion to which an exposed portion of a center conductor of a coaxial cable is to be soldered while being in contact with the bonding portion; and positioning portions provided so as to be able to support the exposed portion of the center conductor at a plurality of positions in an axial direction of the center conductor so as to position the exposed portion of the center conductor at a prescribed position relative to the bonding portion, wherein at least a positioning portion closest to a front end of the center conductor has a support piece that is formed by cutting and erecting, perpendicularly to an axial direction of the center conductor, a portion of the positioning portion and that is formed with a recess in which to place the exposed portion of the center conductor.

9. A coaxial connector contact comprising:

a bonding portion to which an exposed portion of a center conductor of a coaxial cable is to be bonded with solder while being in contact with the bonding portion at a prescribed position;

a first positioning portion that is provided at a position to be located on a front side of the exposed portion of the center conductor and is formed so as to be able to support side faces of the exposed portion of the center conductor from both sides; and a second positioning portion that is provided at a position to be located on a proximal side of the exposed portion of the center conductor and is formed so as to be able to support side faces of the exposed portion of the center conductor from both sides and to be in contact with an end face of an insulator that covers the center conductor.

10. The coaxial connector contact according to claim 9, wherein the second positioning portion has a guide groove whose width increases as the position goes upward and that guides the exposed portion of the center conductor to the prescribed position.

11. A coaxial connector comprising the coaxial connector contact according to claim 9.

* * * * *